US010072382B2

(12) United States Patent
Dwiggins et al.

(10) Patent No.: US 10,072,382 B2
(45) **Date of Patent: *Sep. 11, 2018**

(54) SOFT MULTI-PLY BATH TISSUES HAVING LOW WET ABRASION AND GOOD DURABILITY

(71) Applicant: GPCP IP Holdings LLC, Atlanta, GA (US)

(72) Inventors: John H. Dwiggins, Neenah, WI (US); Daniel W. Sumnicht, Hobart, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/695,074

(22) Filed: Sep. 5, 2017

(65) Prior Publication Data

US 2017/0362777 A1 Dec. 21, 2017

Related U.S. Application Data

(63) Continuation of application No. 15/221,773, filed on Jul. 28, 2016, now Pat. No. 9,783,934, which is a continuation of application No. 14/676,844, filed on Apr. 2, 2015, now Pat. No. 9,441,328, which is a continuation of application No. 14/474,345, filed on Sep. 2, 2014, now Pat. No. 9,045,864, which is a continuation of application No. 14/173,950, filed on Feb. 6, 2014, now Pat. No. 8,877,008.

(60) Provisional application No. 61/804,364, filed on Mar. 22, 2013.

(51) Int. Cl.

| | |
|---|---|
| ***D21H 27/38*** | (2006.01) |
| ***D21H 11/14*** | (2006.01) |
| ***D21H 21/20*** | (2006.01) |
| ***D21H 27/30*** | (2006.01) |
| ***D21H 11/04*** | (2006.01) |
| ***D21H 27/00*** | (2006.01) |

(52) U.S. Cl.

CPC ..... *D21H 27/38* (2013.01); *D21H 11/04* (2013.01); *D21H 11/14* (2013.01); *D21H 21/20* (2013.01); *D21H 27/002* (2013.01); *D21H 27/005* (2013.01); *D21H 27/30* (2013.01)

(58) Field of Classification Search

USPC ..... 162/124

See application file for complete search history.

(56) References Cited

U.S. PATENT DOCUMENTS

| | | | |
|---|---|---|---|
| 4,603,176 | A | 7/1986 | Bjorkquist et al. |
| 4,675,394 | A | 6/1987 | Solarek et al. |
| 4,804,769 | A | 2/1989 | Solark et al. |
| 4,866,151 | A | 9/1989 | Tsai et al. |
| 4,981,557 | A | 1/1991 | Bjorkquist |
| 4,983,748 | A | 1/1991 | Tsai et al. |
| 5,008,344 | A | 4/1991 | Bjorkquist |
| 5,085,736 | A | 2/1992 | Bjorkquist |
| 5,138,002 | A | 8/1992 | Bjorkquist |
| 5,217,576 | A | 6/1993 | Van Phan |
| 5,233,092 | A | 8/1993 | Zaosheng |
| 5,240,562 | A | 8/1993 | Phan et al. |
| 5,314,584 | A | 5/1994 | Grinnell et al. |
| 5,385,643 | A | 1/1995 | Ampulski |
| 5,397,435 | A | 3/1995 | Ostendorf et al. |
| 5,437,766 | A | 8/1995 | Van Phan et al. |
| 5,538,595 | A | 7/1996 | Trokhan et al. |
| 5,573,637 | A | 11/1996 | Ampulski et al. |
| 5,958,187 | A | 9/1999 | Bhat et al. |
| 5,981,044 | A | 11/1999 | Phan et al. |
| 6,149,769 | A | 11/2000 | Mohammadi et al. |
| 7,303,650 | B2 | 12/2007 | Hermans et al. |
| 8,236,135 | B2 | 8/2012 | Prodoehl et al. |
| 8,668,808 | B2 | 3/2014 | Strandqvist |
| 9,045,863 | B2 | 6/2015 | Dwiggins et al. |
| 9,045,864 | B2 | 6/2015 | Dwiggins et al. |
| 9,267,240 | B2 | 2/2016 | Lee et al. |
| 9,309,627 | B2 | 4/2016 | Miller et al. |
| 9,783,934 | B2 * | 10/2017 | Dwiggins ..... D21H 27/38 |
| 2005/0145352 | A1 | 7/2005 | Hermans et al. |

(Continued)

FOREIGN PATENT DOCUMENTS

| | | | |
|---|---|---|---|
| CN | 1138356 | A | 12/1996 |
| CN | 1139468 | A | 1/1997 |
| CN | 102665510 | A | 9/2012 |

(Continued)

OTHER PUBLICATIONS

Chinese Official Action dated Jul. 21, 2017, issued in corresponding Chinese Patent Application No. 201480017326.3, with an English translation.

Notification of and International Search Report dated Apr. 23, 2014, in corresponding International Application No. PCT/US2014/019892.

Written Opinion dated Apr. 23, 2014, in corresponding International Application No. PCT/US2014/019892.

International Preliminary Report on Patentability dated Sep. 22, 2015, in corresponding International Patent Application No. PCT/US2014/019892.

(Continued)

*Primary Examiner* — Mark Halpern

(74) *Attorney, Agent, or Firm* — Laura L. Bozek

(57) ABSTRACT

A multi-ply bath tissue includes a first ply providing a first surface of the bath tissue. The first ply includes first and second layers. The first layer forms the first surface and includes a temporary wet strength resin. The second layer is substantially free from a temporary wet strength resin. A second ply provides a second surface of the bath tissue. The second ply includes first and second layers. The first layer forms the second surface and includes a temporary wet strength resin. The second layer is substantially free from a temporary wet strength resin. The bath tissue is free from regenerated cellulosic microfibers.

32 Claims, 4 Drawing Sheets

(56) References Cited

U.S. PATENT DOCUMENTS

| | | | |
|---|---|---|---|
| 2013/0029105 | A1 | 1/2013 | Miller et al. |
| 2013/0029106 | A1 | 1/2013 | Lee et al. |

FOREIGN PATENT DOCUMENTS

| | | | |
|---|---|---|---|
| JP | 09-509989 | A | 10/1997 |
| JP | 11-506502 | A | 6/1999 |
| JP | 2006-181764 | A | 7/2006 |
| WO | 95/11343 | A1 | 4/1995 |
| WO | 95/11344 | A1 | 4/1995 |
| WO | 95/24529 | A1 | 9/1995 |
| WO | 2011/046478 | A1 | 4/2011 |

OTHER PUBLICATIONS

Australian Office Action dated Feb. 5, 2016, issued in corresponding Australian Patent Application No. 2014237969.

Communication including supplementary European Search Report dated Oct. 19, 2016, issued in corresponding European Patent Application No. 14770459.7-1308/2976462.

Chinese Official Action dated Nov. 2, 2016, issued in corresponding Chinese Patent Application No. 201480017326.3, with an English translation.

U.S. Appl. No. 13/548,600.

Office Action dated Apr. 3, 2018, issued in corresponding Japanese Patent Application No. 2016-504297.

* cited by examiner

SOFT MULTI-PLY BATH TISSUES HAVING LOW WET ABRASION AND GOOD DURABILITY

CROSS REFERENCE TO RELATED APPLICATIONS

This application is a continuation of U.S. patent application Ser. No. 15/221,773, filed Jul. 28, 2016, which matured into U.S. Pat. No. 9,783,934, which is a continuation of U.S. patent application Ser. No. 14/676,844, filed Apr. 2, 2015, which matured into U.S. Pat. No. 9,441,328, which is a continuation of U.S. patent application Ser. No. 14/474,345, filed Sep. 2, 2014, which matured into U.S. Pat. No. 9,045,864, which is a continuation of U.S. patent application Ser. No. 14/173,950, filed Feb. 6, 2014, which matured into U.S. Pat. No. 8,877,008, and which is based on U.S. Provisional Patent Application No. 61/804,364, filed Mar. 22, 2013, which are incorporated herein by reference in their entirety.

BACKGROUND

Field of the Invention

Our invention relates to bath tissues. More particularly, our invention relates to bath tissues that are very soft, have low wet abrasion, and are highly durable.

Related Art

Bath tissues must have a particular combination of properties that is difficult to achieve. On one hand, bath tissues must be soft, in order to be attractive to customers. On the other hand, the bath tissues must be significantly durable in order to satisfy their primary purpose of cleaning and removing material from skin. In general, adjusting the properties of bath tissues to make a softer product will also lead to a less durable product, and vice-versa. Thus, it is difficult to manufacture bath tissues that have an ideal set of properties.

One quantifiable property related to the durability of bath tissues is the cross-directional (CD) wet strength of the tissues. The CD wet strength of bath tissues must, in general, not be too low or too high. If the CD wet strength is too high, the bath tissue will not be flushable. If the CD wet strength is too low, the fibers will be too easily abraded from the surface, meaning that the bath tissues will leave too much lint behind on the surface being cleaned.

One technique for improving the softness of bath tissues is incorporating regenerated cellulose microfibers into the structure of the tissues. Examples of such techniques and bath tissue products that include regenerated cellulose microfibers can be found in U.S. patent application Ser. No. 13/548,600, Publication No. 2013/0029105, now U.S. Pat. No. 9,309,627, the disclosure of which is incorporated by reference in its entirety. Unfortunately, regenerated cellulose microfibers are much more expensive than other papermaking fibers, thereby increasing the cost of bath tissue products that include a significant amount of regenerated microfibers.

Another technique for improving the properties of bath tissues is incorporating a temporary wet strength resin into the structure of the bath tissues. Temporary wet strength resin improves the wet strength of bath tissues, but does not significantly affect the flushability of bath tissues. Temporary wet strength resin, however, also decreases the softness of bath tissues. Thus, prior art bath tissues that include temporary wet strength resin have used a layered (or stratified) structure wherein the temporary wet strength resin is kept away from the outer (Yankee) layers of the bath tissues in order to prevent the temporary wet strength resin from reducing the softness of the bath tissues as much as possible.

SUMMARY OF THE INVENTION

According to one aspect, our invention provides a multi-ply bath tissue. The bath tissue includes a first ply forming a first surface of the bath tissue, the first ply including first and second layers, and a second ply forming a second surface of the bath tissue, the second ply including first and second layers, in which (i) at least one of the first and second layers of at least one of the first ply and the second ply includes a temporary wet strength resin, and (ii) the bath tissue has a cross machine direction (CD) wet tensile strength of between about 50 grams to about 90 grams.

According to another aspect, our invention provides a multi-ply bath tissue. A first ply forms a first surface of the bath tissue, the first ply including first and second layers, and a second ply forms a second surface of the bath tissue, the second ply including first and second layers, in which (i) at least one of the first and second layers of at least one of the first ply and the second ply includes a temporary wet strength resin, and (ii) the bath tissue has a wet abraded line area to cross machine direction (CD) wet tensile strength ratio of less than about 0.333 $mm^2$/gram when the wet abrasion lint area is determined according to the Wet Abrasion Lint Test. According to yet another aspect, our invention provides a multi-ply bath tissue. The bath tissue includes a first ply forming a first surface of the bath tissue, and a second ply forming a second surface of the bath tissue. The bath tissue has a wet abraded lint area to CD wet tensile strength ratio of less than about 0.333 $mm^2$/gram when the web abrasion lint area is determined according to the Wet Abrasion Lint Test.

According to a further aspect, our invention provides a multi-ply bath tissue. A first ply forms a first surface of the bath tissue, the first ply including first and second layers, and a second ply forms a second surface of the bath tissue, the second ply including first and second layers, in which (i) at least one of the first and second layers of at least one of the first ply and the second ply is free from a temporary wet strength resin, and (ii) the bath tissue has a cross machine direction (CD) wet tensile strength of between about 50 grams to about 90 grams.

According to yet another aspect, our invention provides a multi-ply bath tissue. A first ply forms a first surface of the bath tissue, the first ply including first and second layers, and a second ply forms a second surface of the bath tissue, the second ply including first and second layers, in which (i) at least one of the first and second layers of at least one of the first ply and the second ply is free from a temporary wet strength resin, and (ii) the bath tissue has a wet abraded lint area to cross machine direction (CD) wet tensile strength ratio of less than about 0.333 $mm^2$/gram when the web abrasion lint area is determined according to the Wet Abrasion Lint Test.

According to still another aspect, our invention provides a multi-ply bath tissue. A first ply provides a first surface of the bath tissue, the first ply including first and second layers, the first layer of the first ply forming the first surface, the first layer of the first ply including a temporary wet strength resin and the second layer of the first ply being substantially free from a temporary wet strength resin, and a second ply provides a second surface of the bath tissue, the second ply including first and second layers, the first layer of the second ply forming the second surface, the first layer of the second ply including a temporary wet strength resin and the second layer of the second ply being substantially free from a temporary wet strength resin. The bath tissue is free from regenerated cellulosic microfibers.

DETAILED DESCRIPTION OF THE INVENTION

Our invention is directed to multi-ply bath tissues. "Multi-ply," as used herein, refers to bath tissues having more than one ply. In some of the embodiments described herein, the multi-ply bath tissues have three plies, with one of the plies having a different composition than that of the other two plies. Such specifically disclosed embodiments, however, should not be construed as limiting the scope of our invention. For example, the invention also encompasses a two-ply bath tissue product wherein each ply is the same. Further, as will be described in detail below, the individual plies of the bath tissues may each include distinct layers in and of themselves.

Figure 1:
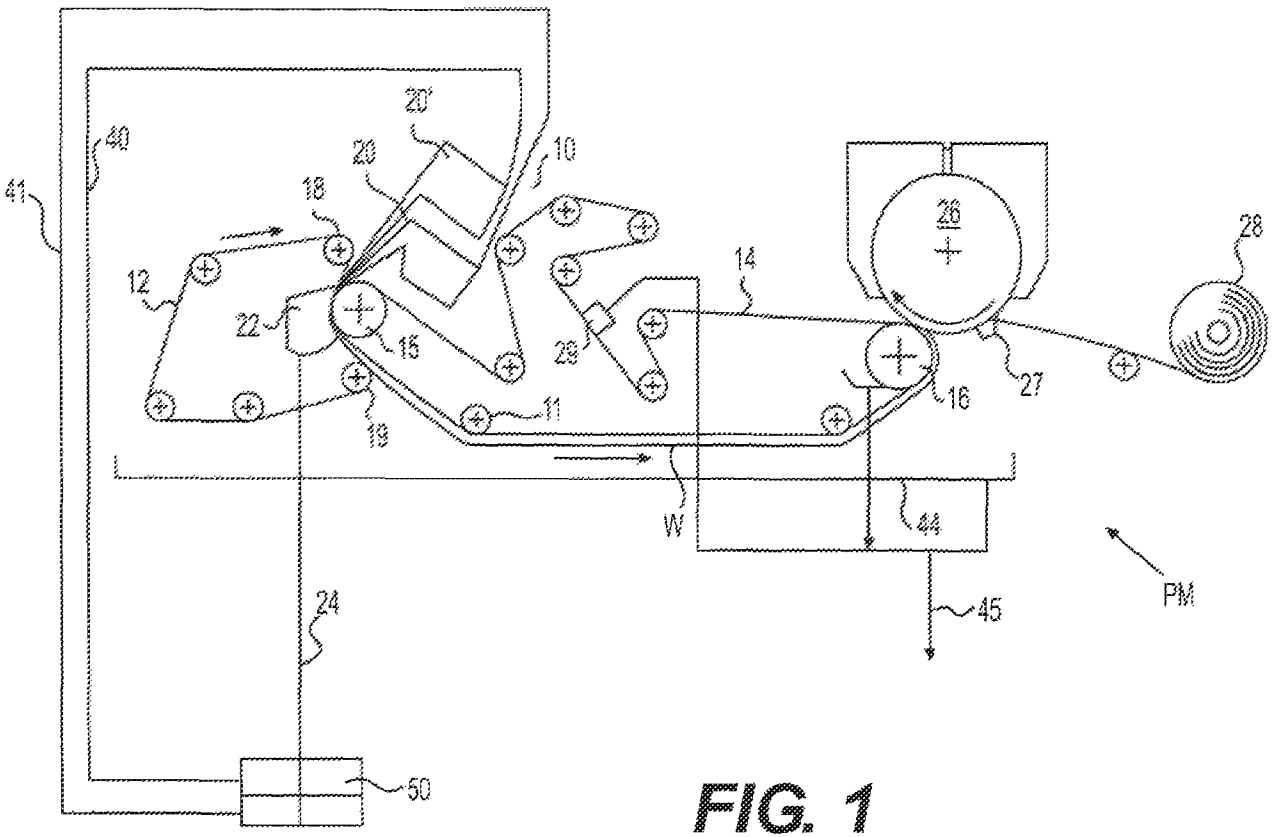
FIG. 1 is a schematic diagram of a paper making machine configuration that can be used to make bath tissues according to the invention.

Bath tissues according to the invention can be made by a conventional wet press papermaking process. Such conventional wet press papermaking processes can be used to make both single and multilayered basesheets that make up the individual plies of bath tissue products. As will be appreciated by those skilled in the art, layered basesheets are formed using a stratified papermaking machine wherein the different layers are formed from different furnishes supplied to the papermaking machine. FIG. 1 shows an example of a conventional wet press papermaking machine PM that is capable of making stratified basesheets. In papermaking machine PM, furnish is fed from a silo 50 into conduits 40 and 41, and then into headbox chambers 20 and 20', respectively, of a forming section configuration 10. The furnish is a liquid slurry of pulp, water, and other chemicals. The headboxes 20 and 20' provide jets of the furnish onto a conventional wire former fabric 12 that is supported by rolls 18 and 19. (The forming section configuration 10 shown in FIG. 1 is often referred to in the art as a crescent former.) When different furnishes are provided to the headbox chambers 20 and 20', the two different jets of furnish from the headbox chambers 20 and 20' will form a stratified web on the fabric 12. The basesheet resulting from the papermaking process will thereby have two distinct layers, with the two layers, by and large, reflecting the different compositions of the two furnishes. The multi-layered basesheet can then be used as a multilayered ply in a bath tissue product. In some embodiments of our invention, each ply of the bath tissues is multilayered. In other embodiments, some of the plies of the bath tissues are multilayered while at least one of the plies is single layered. In this regard, if the same furnish is provided to the headbox chambers 20 and 20' in papermaking machine PM, or if only one of the headbox chambers 20 and 20' supplies the furnish used to form the web W, then there will not be distinct layers in the web formed on the fabric 12, and the resulting basesheet/ply will be single layered as well. In some embodiments of the invention, all of the plies are single layered.

Materials are removed from the web through the fabric 12 in the forming zone, and the materials are moved from a saveall 22 adjacent to a roller 15 through a conduit 24 to the silo 50. The web W is then dried and pressed on a moving felt or fabric 14 that is supported by a roll 11. Materials removed from the web during pressing or from a uhle box 29 are collected in a saveall 44, and then fed to a white water conduit 45. The web W is then pressed by a suction press roll 16 against the surface of a rotating Yankee dryer cylinder 26, which is heated, to cause the web W to substantially dry on the surface of the Yankee dryer cylinder 26. Although not shown in FIG. 1, a shoe press could be used in place of the suction press roll 16 to press the web W against the surface of the Yankee dryer cylinder 26. The moisture within the web W causes the web W to transfer onto the surface of the Yankee dryer cylinder 26. A liquid adhesive, often referred to as creping adhesive, may be applied to the surface of the Yankee dryer cylinder 26, to provide substantial adherence of the web W to the surface of the Yankee dryer cylinder 26. After drying, the web W is then creped from the surface of the Yankee dryer cylinder 26 with a creping blade 27, or with a roller equipped with a fabric. Details of roll creping are generally described in U.S. Pat. No. 5,233,092 and U.S. Pat. No. 5,314,584, the disclosures of which are incorporated herein by reference in their entirety. The creped web W is then optionally passed between calendar rollers (not shown) and rolled up on a roll 28 prior to further converting operations, such as embossing. Such further converting operations will also assemble the single ply formed from the papermaking machine PM with another ply to form a multi-ply bath tissue product.

As one of ordinary skill in the art will certainly appreciate, the papermaking machine PM shown in FIG. 1 is merely exemplary, and there are numerous alternative configurations of papermaking machines. For example, alternatives to the crescent forming section 10 depicted in FIG. 1 include a suction breast-forming roll forming section and a twin wire forming section.

The bath tissues according to the invention may include a variety of cellulosic fibers making up the structure of the bath tissues. In specific embodiments described below, the bath tissues include northern softwood kraft (NSWK) fibers, southern hardwood fibers (SHWF), southern softwood kraft (SSWK) fibers, and eucalyptus fibers. Of course, those skilled in the art will recognize the numerous alternative fibers that could be used to produce the bath tissue products with the properties described herein. Additionally, the bath tissues may also include recycled fibers from any of the above-described fiber sources. Further, as will be described below, the different plies of the multi-ply bath tissues may contain different percentages of the different types of cellulosic fibers.

Bath tissues according to embodiments of the invention typically do not include regenerated cellulose microfiber. As will be appreciated by those skilled in the art, the use of regenerated cellulose microfiber may provide for softer bath tissue products. As will also be appreciated by those skilled in the art, however, regenerated cellulose microfiber is relatively expensive as compared to other types of cellulosic papermaking fibers. The bath tissues according to invention are very soft, as will be demonstrated below, even without the inclusion of regenerated cellulose microfiber in their structure.

The bath tissues according to the invention may also include temporary wet strength resin. Numerous types of temporary wet strength resins are known in the art, and any of the known temporary wet strength resins can be used with the bath tissues according to the invention. As some examples, the temporary wet strength resin can be any one of a variety of water-soluble organic polymers comprising aldehydic units and cationic units used to increase dry and wet tensile strength of the bath tissues. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576, the disclosures of which are incorporated herein in their entireties. Modified starches sold under the trademarks CO-BOND® 1000 and CO-BOND® 1000 Plus, by the National Starch and Chemical Company of Bridgewater, N.J. may also be used. Other temporary wet strength resins that can be used in embodiments of the invention are sold under the trademarks CO-BOND®1600 and CO-BOND® 2300 by the National Starch and Chemical Company. Specific examples of the temporary wet strength agent are indicated below in conjunction with the specifically set forth examples of the product.

The properties and functionality of the bath tissues according to the invention may be tested and characterized in a variety ways. For the bath tissues according to the invention, as well as comparative commercially-available bath tissues, the wet abrasion, the CD wet tensile, the geometric mean (GM) break modulus, and sensory softness were determined. The tests used to determine each of these parameters will now be described.

Wet Abrasion Lint Test

One manner of characterizing a paper product is the Wet Abrasion Lint Test, which evaluates a paper product sample for lint removal by wet abrasion. With respect to bath tissues, in order to be a satisfactory product, the bath tissues must necessarily have a low wet abrasion and thereby not leave a substantial amount of lint behind in a cleaning process.

In the Wet Abrasion Lint Test, a sample is first subjected to simulated wet use against a sample of standard synthetic black felt with a crockmeter rub tester that is modified as described herein. Then, the area in $mm^2$ of the lint left on the felt is measured using a Perfection® Series 4490 flatbed scanner by Seiko Epson Corporation of Suwa, Nagano, Japan, and using Spec*Scan Software by Apogee Systems, Inc., of Powder Springs, Ga.

The crockmeter rub used for the Wet Abrasion Tests conducted herein is made by SDL Atlas, LLC, of Rock Hill, S.C. When used to measure wet lint abrasion herein, the crockmeter was modified to accept a 360 gram arm and a 1 in. by 2 in. foot exerted a pressure on the specimen of 0.435 psi. The weight of the rub block was 355 grams for the weighted arm supported on one end, and 36 grams for the rub foot. These weights are exerted on a 1 in. by 2 in. area so as to result in a pressure of 30.3 grams/$cm^2$. The black felt was 3/16 in. thick and was made by Aetna Felt Corporation of Allentown, Pa.

To test a sample bath tissue, the outer three layers of the bath tissue were removed from a roll of the bath tissue. Three sheets of the bath tissue were cut at the perforations and placed in a stack using a paper cutter to ensure that the tissue sheets were placed in the same orientation relative to the direction and the side of the roll. From the stack, 2 in. by 2.5-in. samples were cut with the long dimension being the machine direction. Enough samples were cut for four replicates. The short (2 in.) side of the tissue was marked with a small dot to indicate the surface of the tissue that was outwardly facing when on the roll. The foot was mounted to the arm of the crockmeter with the short dimension parallel to the stroke of the crockmeter and the stroke distance set at 4 in.±⅛ in., and the stroke speed was set to ten strokes per minute. The black felt is cut into 3 in. by 6 in. pieces, with the inside surface being marked along the short edge. In this test, the tissue sample to be tested was rubbed against the inside of the felt starting at the mark. A 12 in. by 12 in. sheet of black acrylic, a 2 in. by 3 in. glass slide, tape, a pipette, and a beaker of distilled water were located on any nearby convenient flat surface. The crockmeter was turned on, and then turned off, so as to position the arm at its furthest back position. The spacer was placed under the arm to hold it above the rubbing surface. A clean piece of black felt was taped to the base of the crockmeter over the rubbing surface with the marked surface oriented upward, and with the marked end up adjacent to the beginning point of the stroke of the foot. A sample was taped along one shorter edge to the foot with the top side of the tissue facing up, and the length of the tissue was wrapped around the foot and attached to the arm of the crockmeter with the taped side and the marked location on the tissue sample facing the operator at the forward portion of the crockmeter. The spacer was removed from under the arm, and the arm with the attached foot was set down on the black felt with the long dimension of the foot perpendicular to the rub direction, and the foot was fixed in place. The glass microscope slide was placed on the felt forward of the foot and 3 volumes of 200 μL of distilled water each were dispensed from the pipette onto the cross-marks on the glass slide. The sample, foot, and arm were gently lifted, the glass slide was placed under the sample, and the sample was lowered to allow the water to wet the sample for five seconds. The arm was then lifted, the glass slide was removed, and the crockmeter was activated to allow the sample to make three forward strokes on the felt with the arm being lifted manually at the beginning of each return stroke to prevent the sample from contacting the felt during the return strokes. After three forward strokes, the crockmeter was deactivated and the spacer was placed under the arm so that the black felt could be removed without disturbing the abraded lint thereupon. Three minutes after the felt was removed from the rubbing surface, it was scanned on the flatbed scanner using the Apogee Spec*Scan Software with the software being set for "lint" in the "Scanner Settings" window, with "5" being set in the "Process Groups of:" window on the "Defaults panel," the "Resolution" being set at "600 dots/inch," the "Scanner Mode" being set to "256-Grayscale," the "Area Setting" being set to "Special," the "Scan Image" being set to "Reverse Image," the "Upper Limit" window on the "Dirt Histogram" panel being set to ">=5.000," the "Lower Limit" window of that panel being set to "0.013-0.020," and the "X Scale:" window being set to "25," and the "PPM" window of the "Bad Handsheet" panel set to "2500.0." On the "Printout Settings:" panel, the "Gray-Summary", "Sheet Summary" and "Gray Histogram" boxes were checked, the "Copies" window were set to "1", while the "Dirt Histogram," "Categories," and "XY Location" boxes on that panel were unchecked. Both the "Enable Display" and "Enable Zoom" boxes were checked on the Display Mode panel. On the "Scanner Setup" panel, the "White" box was set for "255" while the "Black" box was set for "0," the "Contrast Filter" box was set for "0.000," the upper "Threshold=" box was set for 80.0 [% percent of background plus] while the lower "Threshold=" box was set for "0.0" [grayscale value]. The "Percent of Background, plus offset" box on the "Scanner Setup" panel was checked while the "Manual Threshold Setting" and "Function of StdDev of Background" boxes were unchecked. On the "Special Area Definition" panel, "Inches" was checked in the "Dimensions:" region while "Rectangular" was checked in the "Shape:" region. In the "Border at top and left:" region, "0.15" [in.] was entered in the "At the left side: (X)" box and "0.625" [in.] is entered in the "At the top: (Y)" box. In the "Area to scan:" regions "2.7" [in.] was entered in the "Width (X)" box and "5.2" [in.] was entered in the "Height (Y)" box. After scanning, the area in $mm^2$ of the abraded lint left on the black felt is output in the "SHEETS" Table in the "Total Area" column under the "Sample Sheet(s)" heading on the "Sheet & Category Summary" screen. The result is referred to herein as Wet Abraded Lint Area, which has units of $mm^2$.

In other cases, the removed fiber was washed off and the solution was subjected to testing in a Fiber Quality Analyzer made by OpTest Equipment Inc., of Hawkesbury, Canada, in order to determine the number of fibers that were removed having a length in excess of 40 μm. The OpTest Fiber Quality Analyzer has become a standard in the paper industry for determining fiber length distributions and fiber counts above a certain minimal length.

CD Wet Tensile

The CD wet tensile of the tissue of the present invention is measured generally following the Technical Association of the Pulp and Paper Industry (TAPPI) Method T 576 pm 7, using a three in. (76.2 mm) wide strip of tissue that is folded into a loop, clamped in a special fixture termed a Finch Cup, then immersed in water. A suitable three in. Finch cup, with base to fit a three in. grip, is available from High-Tech Manufacturing Services, Inc., of Vancouver, Wash.

For fresh basesheet (i.e., a one ply product of a papermaking operation) and finished products, the test specimens were placed in a forced air oven heated to 105° C. (221° F.) for five minutes. The Finch cup was mounted onto a tensile tester equipped with a 2.0 pound load cell with the flange of the Finch cup clamped by the tester's lower jaw and the ends of tissue loop were clamped into the upper jaw of the tensile tester. The samples were immersed in water that has been adjusted to a pH of 7.0±0.1 and the tensile was tested after a five second immersion time using a crosshead speed of 2 in./minute. The results are expressed in grams/$in.^3$, dividing the readout by two to account for the loop as appropriate.

GM Break Modulus

The GM break modulus of the samples was tested with a standard test device manufactured by the Instron Corporation of Norwood, Mass., or using another suitable elongation tensile tester device. Such a device may be configured in various ways, but typically uses three in. or one in. wide strips of tissue, conditioned in an atmosphere of 23° C.±1° C. (73.4° F.±0.1° F.) at 50% relative humidity for two hours. The tensile test was run at a crosshead speed of two in./min. GM break modulus was expressed in grams/$in.^3$/% strain or its SI equivalent of grams/$mm^3$/% strain. The percent strain is dimensionless and need not be specified. Note that the "GM" break modulus refers to the square root of the product of the MD and CD values.

Sensory Softness

Sensory softness of the samples was determined by using a panel of trained human subjects in a test area conditioned to TAPPI standards (temperature of 71.2° F. to 74.8° F., relative humidity of 48% to 52%). The softness evaluation relied on a series of physical references with predetermined softness values that were always available to each trained subject as they conducted the testing. The trained subjects directly compared test samples to the physical references to determine the softness level of the test samples. The trained subjects assigned a number to a particular paper product, with a higher sensory softness number indicating a higher perceived softness.

Bath Tissues

Figure 2:
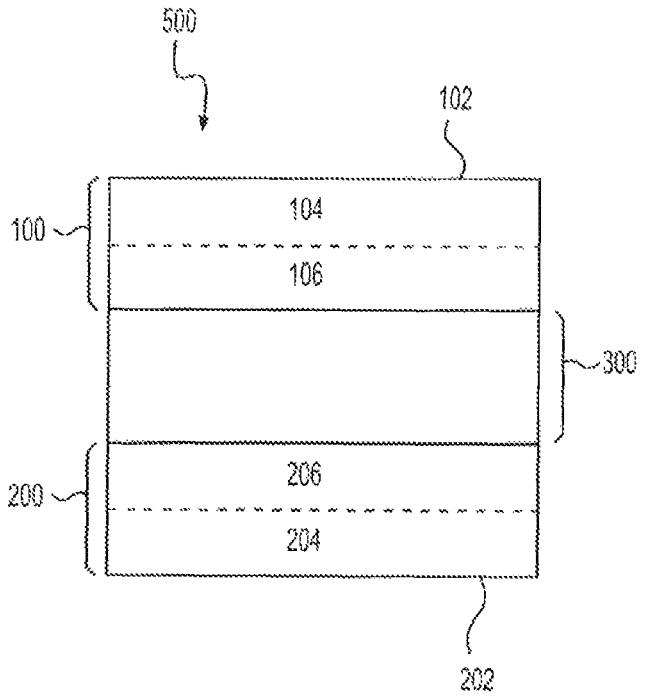
FIG. 2 is a schematic diagram of the structure of a bath tissue according to the invention.

FIG. 2 is a schematic diagram of the structure of a multi-ply bath tissue 500 according to an embodiment of the invention. As indicated in the diagram, the multi-ply bath tissue 500 includes a first ply 100 and a second ply 200, with a third ply 300 sandwiched between the first ply 100 and the second ply 200. The first ply 100 includes a first layer 104 and a second layer 106, with the first layer 104 forming a first surface 102 of the bath tissue 500. The second ply 200 includes a first layer 204 and a second layer 206, with the first layer 204 forming a second surface 202 of the bath tissue 500. The distinct layers 104, 106, 204, and 206 are formed using a stratified papermaking machine, such as the papermaking machine PM described above with respect to FIG. 1. The first layers 104 and 204 forming the first and second surfaces 102 and 202 are the Yankee-side layers, i.e., formed from the side of the web that contacts the Yankee dryer 26 in a papermaking process.

While a three-ply bath tissue 500 is shown in FIG. 2, it should be understood that our invention is not restricted to three-ply products. In other embodiments, the bath tissue 500 may include two plies, such as the first ply 100 and the second ply 200 shown in FIG. 2. In still other embodiments, the bath tissue 500 may include more than three plies. For example, an additional ply having the configuration of the third ply 300 can be provided to the configuration shown in FIG. 2, with the additional ply being provided in the area between the first ply 100 and the second ply 200.

The first and second plies 100 and 200 may be made up of different types of cellulosic fibers that are used to form paper products. In specific embodiments of the invention, however, the first and second plies 100 and 200 include NSWK and *eucalyptus* fibers. As discussed above, however, the first ply 100 and the second ply 200 may be free from regenerated cellulosic microfibers. As will be demonstrated by the examples of bath tissues according to the invention set forth below, the first and second plies 100 and 200 that form the surfaces of the bath tissue 500 product are very soft, even without the provision of regenerated cellulosic microfibers in their structure.

Unlike the first and second plies 100 and 200, in some embodiments of the invention, the third ply 300 of the bath tissue 500 only includes a single layer. The third ply 300 may also differ from the first and second plies 100 and 200 in terms of fiber composition. In embodiments of the invention, the third ply 300 includes southern hardwood fibers, southern softwood fibers, and recycled fibers. Notably, as the third ply 300 is sandwiched between the first and second plies 100 and 200, the softness of the third ply 300 is not critical to what is perceived by the user. As such, there is a greater range of options for the fibers to be used to form the third ply 300. And, as will be appreciated by those skilled in the art, southern hardwood fibers, southern softwood fibers, and recycled fibers are relatively inexpensive choices for forming such a ply.

Overall, the bath tissue 500 according to the invention may include at least about 14% NSWK fibers, and more specifically, at least about 25% NSWK fibers. In a particular embodiment, the bath tissue 500 includes about 14% to about 40% NSWK fibers and about 60% and about 86% eucalyptus fibers.

The bath tissue 500 includes a temporary wet strength resin, such as one of the resins described above. In some embodiments of the invention, the temporary wet strength resin is provided throughout the bath tissue 500 product. For example, the temporary wet strength resin can be evenly distributed between the first and second layers 104 and 106 of the first ply 100, and evenly distributed between the first and second layers 204 and 206 of the second ply 200. In other embodiments of the invention, however, the temporary wet strength resin is provided in the first layers 104 and 204, but not in the second layers 106 and 206 of the first and second plies 100 and 200, respectively. Thus, the second layers 106 and 206 are substantially free from temporary wet strength resin. Note, a layer is "substantially free from wet strength resin," as used herein, when the layer is formed without a temporary wet strength resin being added to the pulp that provides the furnish for forming the layer. As will be appreciated by one of ordinary skill in the art, even in a highly-efficient stratified papermaking process, a certain amount of mixing will occur between the layers of the web during the papermaking process. Nevertheless, a layer will still be substantially free from a temporary wet strength resin if a temporary wet strength resin is not added to the pulp for the furnish that is used to form the layer.

In some embodiments, the third ply 300 also includes a temporary wet strength resin. If the third ply 300 of the bath tissue 500 only includes a single layer, then the temporary wet strength resin is distributed throughout the third ply 300. The amount of temporary wet strength resin provided in the third ply 300 may be the same as that provided in the first and second plies 100 and 200, or the temporary wet strength resin may be less than the temporary wet strength resin that is provided in the first and second plies 100 and 200.

The bath tissues according to the invention have a surprising combination of abrasive strength and softness. These outstanding properties of the bath tissues can be seen quantitatively when considering several different aspects of the bath tissues according to the invention, including CD wet tensile strength, Wet Abrasion Lint Test results, GM break modulus, calipers, basis weights, and sensory softness. Note, specific examples of bath tissues according to the invention will be described below.

In embodiments of the invention, the CD wet tensile of the bath tissues may range from about 50 grams to about 90 grams (as determined in accordance with the procedure described above). In more specific embodiments, the CD wet tensile may range from about 55 grams to about 85 grams, and in still more specific embodiments, the CD wet tensile may range from about 65 grams to about 75 grams. As will be appreciated by one of ordinary skill in the art, with the CD wet tensile being within these ranges, the bath tissues will still be flushable, while at the same time, the bath tissues will still having a substantial amount of strength and durability.

While being appreciably strong and durable in terms of CD wet tensile, the bath tissues according to the invention nevertheless have a low wet abrasion. This can be demonstrated when testing the bath tissues with the Wet Abrasion Lint Test, the procedure of which is described above. In embodiments of the invention, the bath tissues have a wet abraded lint area of about 3 $mm^2$ to about 30 $mm^2$ when tested in accordance with the Wet Abrasion Lint Test. As will be appreciated by those skilled in the art, this range represents very low wet abrasion for a bath tissue. The range is even more striking when considered in combination with the CD wet tensile of the bath tissues. This combination of low wet abrasion and CD wet tensile can be quantified as a ratio of these two properties. In embodiments of the invention, the bath tissues can have a ratio of wet abraded lint area to CD wet tensile strength of less than about 0.333 $mm^2$/gram. More specifically, the bath tissues can have a wet abraded lint area to CD wet tensile strength of 0.06 $mm^2$/gram to about 0.333 $mm^2$/gram. In more specific embodiments, the bath tissues can have a wet abraded lint area to CD wet tensile strength of about 0.15 $mm^2$/gram to about 0.25 $mm^2$/gram. In a particular embodiment of the invention, a bath tissue has a wet abraded lint area to CD wet tensile strength of about 0.20 $mm^2$/gram. As will be demonstrated in the examples below, these ratios of wet abrasion to CD wet tensile of bath tissues according to the invention are not found in commercially-marketed bath tissues.

Other properties of bath tissues according to the invention are equal to, or even better than, the properties of commercially-marketed bath tissues. For example, in embodiments of the invention, the bath tissues have a GM break modulus of less than about 60 grams/% strain, a caliper of greater than about 130 mils/8 plies, and a basis weight of about 30 lbs/ream to about 40 lbs/ream. Specific examples of bath tissues with these properties are described in the examples below.

EXAMPLES

Four bath tissue products were manufactured according to embodiments of the invention. The bath tissue products included three plies, as generally described above. The two outer plies of the bath tissue products were made according to one of four experimental conditions, which are described in detail below in TABLES 1A to 4A. The middle (sandwiched) ply had a composition and structure that is described in TABLES 1B to 4B.

The experimental conditions for making Bath Tissue A are shown in TABLE 1A for the outer plies and TABLE 1B for the center ply. For this experiment, a conventional wet pressing process on a papermaking machine was used. The papermaking machine was generally configured in the manner of the papermaking machine shown in FIG. 1.

TABLE 1A

| | Paper Machine Parameter | Target Value/Max. & Min. (if applicable) |
|---|---|---|
| Furnish | Forming mode | Crescent former, stratified, Yankee layer 45% of total sheet, air side layer 55% of total sheet |
| | Furnish chemicals: biocides/enzymes, etc. | None |
| | Total furnish | Yankee side: 45% of total: 70% eucalyptus (Aracruz) 30% NSWK Air side: 55% of total: 66% NSWK (Dryden) 34% eucalyptus |
| Forming | Retention aid(s) type and addition rate | None |
| | Headbox slice opening (inches) and position from nip/forming roll | 0.580 to 0.640 |

TABLE 1A-continued

| | Paper Machine Parameter | Target Value/Max. & Min. (if applicable) |
|---|---|---|
| Strength Control | Refiner amps or Kw or HP-Days/ton (if applicable) | None |
| | Wet end pH and chemical(s) for pH control | 6.4 |
| | Rush-drag (fpm) | As needed for tensile ratio |
| | Spray softener | PA-A at 80 $cm^3$/min. (2.2 lbs/ton) |
| | Wet strength chemical and addition rate | HERCOBOND ™ 1194: 1625 cc/min |
| | Control of dry strength (wet end debonder type and cc/min) | 10 cc/min |
| | Control of dry strength | N/A |
| Creping | Yankee steam pressure (psig) | 94 |
| | Yankee hood temperatures | 737 |
| | Reel Crepe % (Yankee speed-reel speed)/Yankee speed | 26.7 |
| | Yankee adhesive type | Buckman 2620 |
| | Yankee modifier/release type (cc/min) | BUSPERSE ® 2097 |
| | Yankee extender | Buckman 2675 extender |
| Calender-ing | Cal Load F/B | as needed |
| | Cleaning blade | 10° bevel (run all the time) |

TABLE 1B

| | Paper Machine Parameter | Target Value/Max. & Min. (if applicable) |
|---|---|---|
| Furnish | Forming mode | Stratified, Yankee layer 40% to 50% of total sheet |
| | Furnish chemicals: biocides/enzymes etc. and addition rates in lb/ton | None |
| | Total furnish | Yankee side: 50% Naheola SW Air side: 25% NSWK (Dryden), 25% mill secondary/broke |
| Forming | Retention aid(s) type and addition rate | None |
| | Headbox slice opening (inches) and position from nip/forming roll | 0.580 to 0.640 |
| Strength Control | Refiner amps or Kw or HP-Days/ton (if applicable) | Run backed off 88 kw or by-passed |
| | Wet end pH and chemical(s) for pH control | 6.4 |
| | Rush-drag (fpm) | As needed for tensile ratio |
| | Spray softener | None |
| Strength Control | Wet strength chemical and addition rate | HERCOBOND ™ 1194 430 cc/min or as needed to hit CD wet target |
| | Control of dry strength (wet end debonder type (cc/min)) | Ashland TQ 236 as needed |
| | Control of dry strength | N/A |
| Creping | Yankee steam pressure (psig) | 70-80 |
| | Yankee hood temperatures (° F.) | 800 |
| | Reel Crepe % (Yankee speed-reel speed)/Yankee speed | 25.7 |

TABLE 1B-continued

| | Paper Machine Parameter | Target Value/Max. & Min. (if applicable) |
|---|---|---|
| | Yankee Adhesive Type in cc/min | CREPETROL ™ 1145; add Ashland PPD 1117 plasticizer if needed to soften coating |
| | Yankee Modifier/release type | Ashland 4609 |
| Calender-ing | Cal Load F/B | Open |
| | Cleaning Blade | 10° bevel (run all the time) |

The experimental conditions for making Bath Tissue B are shown in TABLE 2A for the outer plies and TABLE 2B for the middle ply. For this experiment, a conventional wet pressing process on a papermaking machine was used. The papermaking machine was generally configured in the manner of the papermaking machine shown in FIG. 1, except that the papermaking machine had a twin wire forming section, followed by a felt section.

TABLE 2A

| | Paper Machine Parameter | Target Value/Max. & Min. (if applicable) |
|---|---|---|
| Furnish | Forming mode | Twin wire, homogeneous |
| | Furnish chemicals: biocides/enzymes etc. | None |
| | Total furnish | Virgin fiber: 60% eucalyptus/40% NSWK |
| Forming | Retention aid(s) type and addition rate | None |
| | Headbox slice opening (inches) and position from nip/forming roll | As needed for good formation |
| Strength Control | Refiner amps or Kw or HP-Days/ton (if applicable) | unloaded and recirculation is set at 40% |
| | Wet end pH and chemical(s) for pH control | 5.4 urea sulfate |
| | Rush-drag (fpm) | 58 |
| | Spray softener | VARISOFT ® GP B 100 at 200 cc/min (4 lbs/ton). |
| | Wet strength chemical and addition rate | PAREZ ® FJ98 at 3.86 lbs/ton |
| | Control of dry strength (wet end debonder type) | None |
| | Control of dry strength (type and addition level of non-wet strength starch) | None |
| Creping | Yankee steam pressure (psig) | 105 |
| | Second press roll | Unloaded |
| | Yankee hood temperatures (° F.) | 575 |
| | Reel crepe % (Yankee speed-reel speed)/Yankee speed | 25.5 |
| | Yankee adhesive type | Buckman 2620 |
| | Yankee modifier/release type | BUSPERSE ® 2097 |
| | Yankee extender | Buckman 2675 |
| Calender-ing | Cal load F/B | 43.5/43.5 |
| | Skewing | 3 |

TABLE 2B

| | Paper Machine Parameter | Target Value/Max. & Min. (if applicable) |
|---|---|---|
| Furnish | Forming mode | Homogeneous |
| | Furnish chemicals: biocides/enzymes etc. | None |
| | Total Furnish | 50% Softwood Slush<br>50% Hardwood Slush |
| Forming | Retention aid(s) type and addition rate | None |
| | Headbox slice opening (inches) and position from nip/forming roll | None |
| Strength Control | Refiner HP-Days/ton (if applicable) | By-Pass |
| | Wet end pH | 5.5 |
| | Rush-drag | +58 |
| | Spray Softener | None |
| | Wet strength chemical and addition rate | PAREZ ® FJ98 0.26 gpm, adjusted as necessary |
| | Control of dry strength (wet end debonder type) | N/A |
| | Control of dry strength | N/A |
| Creping | Yankee steam pressure (psig) | 110 |
| | Yankee hood temperatures | As needed; ~650° F. |
| | Reel Crepe % (Yankee speed-reel speed)/Yankee speed | 28 |
| | Yankee adhesive type | Buckman 2620 |
| | Yankee modifier/release type | BUSPERSE ® 2097 |
| | Yankee Extender type | Buckman 2675 |
| Calendering | Cal 1 Load F/B | None (may use if necessary for sheet handling) |

The experimental conditions for making Bath Tissue C are shown in TABLE 3A for the outer plies and TABLE 3B for the center ply. For this experiment, a papermaking machine with a conventional wet pressing process was used. The papermaking machine was generally configured in the manner of the papermaking machine shown in FIG. 1, except that the papermaking machine had a twin wire forming section, followed by a felt section.

TABLE 3A

| | Paper Machine Parameter | Target Value/Max. & Min. (if applicable) |
|---|---|---|
| Furnish | Forming mode | Twin wire, homogeneous |
| | Furnish chemicals: biocides/enzymes etc. | SPECTRUM ™ XD3899<br>100 cc/min for 20 min. 5 times a day |
| | Total furnish | 19.4% NSWK<br>81.6% eucalyptus |
| Forming | Retention aid(s) type and addition rate | None |
| | Head box slice opening (inches) and position from nip/forming roll | As needed for good sheet formation |
| | Charge Control | N/A |
| | Defoamer | Nalco PP07-3811 (as needed) |
| Strength Control | Refiner amps or Kw or HP-Days/ton (if applicable) | Start at 50 amps |
| | Wet end pH and chemical(s) for pH control | 5.4 (usage controlled by demand) |
| | Rush-drag, fpm | As needed |
| | Spray softener | VARISOFT ® GP B 100 at 5.0 lb/ton |
| | Wet strength chemical | Into second (Yankee layer) only: PAREZ ® FJ98, 7 lb/ton |

TABLE 3A-continued

| | Paper Machine Parameter | Target Value/Max. & Min. (if applicable) |
|---|---|---|
| Strength Control | Control of dry strength (wet end debonder type) | As needed to reduce tensiles to target if refining is at the minimum |
| | Control of dry strength and/or turn up aid (type of non-wet strength starch) | None |
| Creping | Yankee steam pressure (psig) | 107 |
| | Yankee hood temperatures | 675 |
| | Reel Crepe % (Yankee speed-reel speed)/Yankee speed | 22.5 |
| | Yankee adhesive type | Clearwater CS124<br>Clearwater CS206 |
| | Yankee modifier/release type | Clearwater CS329 |
| Calendering | Cal 1 Load F/B (psig) | Corse 25/22 |
| | Cal 2 Load F/B (psig) | Loaded to caliper target |

TABLE 3B

| | Paper Machine Parameter | Target Value/Max. & Min. (if applicable) |
|---|---|---|
| Furnish | Forming Mode | Homogeneous |
| | Total Furnish | 40% slush SW<br>50% slush HW<br>10% Machine broke |
| Strength Control | Refiner HP-Days/Ton (if applicable) | 184 kw/64.6 amps |
| Strength Control | Wet end pH | 5.5 |
| | Rush-Drag (fpm) | −690 |
| | Spray Softener | None |
| | Wet strength chemical and addition rate | PAREZ ® FJ98 at 425 cc/min |
| | Control of dry strength (wet end debonder type) | Buckman 792 at 80 cc/min |
| | Control of Dry Strength (type and addition level of non-wet strength starch) | N/A |
| Creping | Yankee Steam Pressure (psig) | 100 |
| | Yankee Hood Temperatures (° F.) | 730 |
| | Reel Crepe % (Yankee speed-reel speed)/Yankee speed | 24% |
| | Yankee adhesive type | Buckman 2620<br>Buckman 2675 |
| | Yankee modifier/release type | BUSPERSE ® 2097 |
| Cleaning Blade | Cleaning blade bevel and loading | As needed |
| Calendering | | Closed but not loaded to help sheet handling |

The experimental conditions for making Bath Tissue D are shown in TABLE 4A for the outer plies and TABLE 4B for the middle ply. For this experiment, a papermaking machine with a conventional wet pressing process was used. The papermaking machine was generally configured in the manner of the papermaking machine shown in FIG. 1, except that the papermaking machine had a suction breast roll forming section, followed by a felt section.

TABLE 4A

| | Paper Machine Parameter | Target Value/Max. & Min. (if applicable) |
|---|---|---|
| Furnish | Forming mode (homogeneous or stratified) | Homogeneous, suction breast roll |
| | Furnish chemicals: biocides/enzymes etc. | Sodium hypochlorite and sodium bisulfite in the broke |
| | Total furnish | 14% NSWK peace river, 86% fibra eucalyptus |
| Forming | Retention aid(s) type and addition rate | None |
| | Head box slice opening (inches) and position from nip/forming roll | As needed for good formation |
| | Charge control | None |
| | Batch cleaner | As needed to keep felt clean |
| Strength Control | Refiner HP-Days/ton (if applicable) | 120 A |
| | Wet end pH | 5.5; 93% sulfuric acid |
| | Rush-drag (fpm) | −320 |
| | Spray softener | PA-A at 125 cc/min |
| | Wet strength chemical and addition rate | PAREZ ® FJ98 at 9.4 lb/ton |
| | Control of dry strength (wet end debonder type) | VARISOFT ® GP C wet end debonder as needed |
| Strength Control | Control of dry strength and/or turn up aid (type and addition level of non-wet strength starch) | None |
| Creping | Yankee steam (psig) | 100 |
| | Yankee hood temperature (° F.) | 713 |
| | Reel Crepe % (Yankee speed-reel speed)/Yankee speed | 24 |
| | Yankee adhesive type | Buckman 2620<br>Buckman 2675 |
| | Yankee modifier/release | BUSPERSE ® 2097 |
| Calendering | | To caliper target |

TABLE 4B

| | Paper Machine Parameter | Target Value/Max. & Min. (if applicable) |
|---|---|---|
| Furnish | Forming mode | homogeneous |
| | Total furnish | 50% secondary fiber<br>30% NSWK<br>20% mill secondary |
| | Furnish chemicals: biocides/enzymes etc. | Sodium hypochlorite and sodium bisulfite in the broke |
| | pH Control | 5.8; 93% sulfuric acid |
| Forming | Retention aid(s) type and addition rate | None |
| | Head box slice opening (inches) and position from nip/forming roll | As needed for good formation |
| Forming | Charge Control | None |
| | Batch Cleaner | As needed to keep the felt clean |

TABLE 4B-continued

| | Paper Machine Parameter | Target Value/Max. & Min. (if applicable) |
|---|---|---|
| Strength Control | Refiner HP-Days/ton (if applicable) | By-passed |
| | Wet end pH | 6.0 |
| | Rush-drag (fpm) | −258 |
| | Spray softener | none |
| | Wet strength chemical and addition rate | PAREZ ® FJ98 at 650 cc/min |
| | Control of Dry Strength (wet end debonder type) | VARISOFT ® GP C at 260 cc/min |
| | Control of Dry Strength (type and addition level of non-wet strength starch) | None |
| Creping | Yankee steam pressure (psig) | 80 |
| | Yankee hood temperature (° F.) | 670 |
| | Reel Crepe % (Yankee speed-reel speed)/Yankee speed | 28 |
| | Yankee adhesive type | CREPETROL ™ 3557 |
| | Yankee modifier/release type | PROSOFT ® TR 8630 |
| Cleaning Blade | Cleaning blade bevel and loading | As needed |
| Calendering | | Closed at minimum load |

With respect to the specific compositions noted in TABLES 1A to 4B, PA-A softener is available from RCI Technology, Inc. of Charlotte, N.C. HERCOBOND™ 1194, CREPETROL' 1145, CREPETROL™ 3557, PROSOFT® TR 8630, Ashland PPD 1117, Ashland 4609, Ashland TQ 236, and SPECTRUM™ XD3899 are available from the Ashland Chemical Company of Hale Thorpe, Md. Buckman 2620, Buckman 2675, and BUSPERSE® 2097 are available from Buckman Laboratories International, Inc. of Memphis, Tenn. VARISOFT® GP B 100 is available from Evonik Industries of Essen, Germany. Nalco PP07-3811 is available from Nalco Company of Naperville, Ill. PAREZ® FJ98 is available from Kemira Chemicals, Inc. of Kennesaw, Ga. Clearwater CS124, CS206, and CS329 are available from Clearwater Specialties LLC of Clarkston, Wash.

The measured properties of the Bath Tissues A to D are shown in TABLES 5-1 and 5-2. Also shown in TABLES 5-1 and 5-2 are the same measured properties for Comparative Bath Tissues 1-10. Comparative Bath Tissues 1-3 were commercial products sold by the assignee of the present application. Comparative Bath Tissues 4-10 were commercial products sold by other manufacturers. Thus, the data in TABLES 5-1 and 5-2 demonstrate a good comparison between the bath tissues according to the invention and other bath tissue products. Note that the CD wet tensile, GM break modulus, sensory softness, and wet abrasion lint area values shown in TABLES 5-1 and 5-2 were determined in accordance with the tests described above.

TABLE 5-1

| | Bath Tissue A | Bath Tissue B | Bath Tissue C | Bath Tissue D | Comp. Tissue 1 | Comp. Tissue 2 | Comp. Tissue 3 |
|---|---|---|---|---|---|---|---|
| Number of Plies | 3 | 3 | 3 | 3 | 3 | 2 | 2 |
| CD Wet Tensile (g/in.$^3$) | 57 | 86 | 74 | 70 | 40 | 68 | 56 |
| GM Break Modulus (g/% strain) | 45.4 | 59.3 | 51.9 | 58.0 | 50.3 | 65.0 | 56.0 |
| Sensory Softness | 20.0 | 20.0 | 20.0 | 20.3 | 20.0 | 18.3 | 18.2 |
| Wet Abrasion Lint Area (mm$^2$) | 8.9 | 5.3 | 13.1 | 13.7 | 90 | 37 | 51 |
| Wet Abrasion Lint Area/CD Wet Tensile Ratio | 0.16 | 0.06 | 0.18 | 0.20 | 2.25 | 0.54 | 0.91 |

TABLE 5-2

| | Comp. Tissue 4 | Comp. Tissue 5 | Comp. Tissue 6 | Comp. Tissue 7 | Comp. Tissue 8 | Comp. Tissue 9 | Comp. Tissue 10 |
|---|---|---|---|---|---|---|---|
| Number of Plies | 2 | 2 | 2 | 1 | 2 | 1 | 1 |
| CD Wet Tensile (g/in.$^3$) | 57 | 34 | 68 | 42 | 35 | 48 | 9 |
| GM Break Modulus (g/% strain) | 44.7 | 63.5 | 69 | 61.3 | 75.0 | 72.9 | 76.4 |
| Sensory Softness | 20.6 | 19.3 | 18.5 | 17.7 | 17.0 | 18.0 | 15.8 |
| Wet Abrasion Lint Area (mm$^2$) | 97 | 45 | 40 | 18 | 59 | 46 | Not Measureable |
| Wet Abrasion Lint Area/CD Wet Tensile Ratio | 1.70 | 1.32 | 0.59 | 0.43 | 1.69 | 0.96 | Failed Test |

Note that Comparative Bath Tissue 10 disintegrated when being tested according to the Wet Abrasion Lint Test, thus making it impossible to determine the wet abrasion lint area and ratio of wet abrasion lint area to CD wet tensile ratio for this sample.

As discussed above, it is well known in the art that, in order to increase the durability and abrasion properties of the tissue, the strength must be increased significantly, which increases the GM modulus (or stiffness) of the paper and reduces the softness of the tissue. Therefore, the combination of the low wet abrasion properties at a given CD wet tensile and relatively lower GM modulus and very high softness of Bath Tissues A-D of the invention are uniquely superior to the Comparative Bath Tissues 1-10, which were commercially produced. This is illustrated in TABLES 5-1 and 5-2 and shown in FIGS. 3 and 4. In particular, the wet abrasion lint area to CD wet tensile ratios for the Bath Tissues A to D were much lower than any of those ratios for the Comparative Bath Tissues 1-10. In this regard, the web abrasion lint area for Bath Tissues A to D was lower than any of Comparative Bath Tissues 1-10. Considering CD wet tensile individually, while the CD wet tensile of Bath Tissues A to D was comparable to, or not significantly greater than, the CD wet tensile of Comparative Bath Tissues 1-10, the GM break modulus (stiffness) of Bath Tissues A to D was also equal to three comparative products and lower than seven of the Comparative Tissues 1-10. Still further, the sensory softness for Bath Tissues A to D was greater than eight of Comparative Bath Tissues 1-10. Thus, the data in TABLES 5-1 and 5-2 indicates that the Bath Tissues A to D had a demonstrably better combination of low wet abrasion, durability, and softness than any of Comparative Bath Tissues 1-10.

Figure 3:
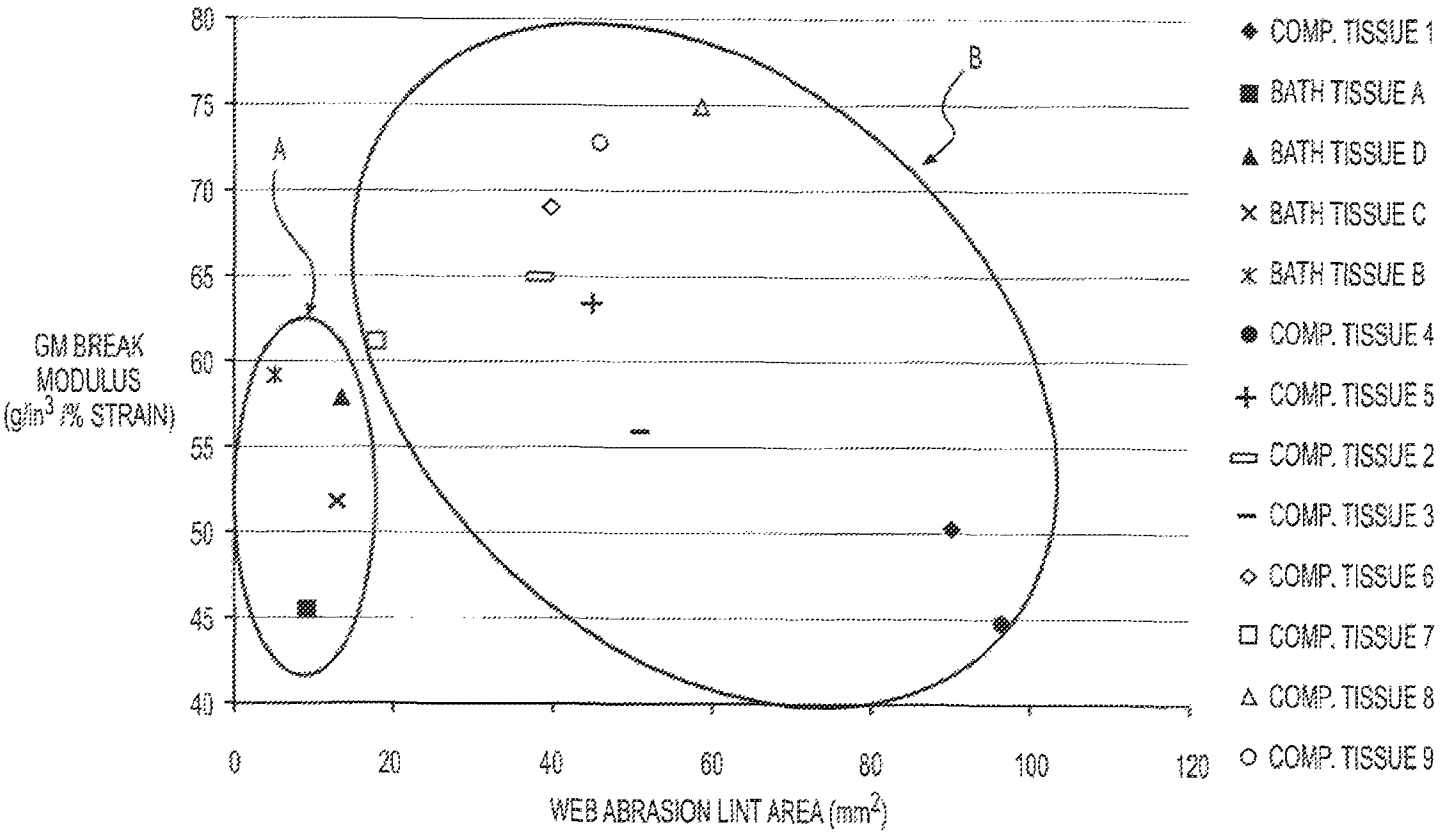
FIG. 3 is a plot showing the relation of Wet Abrasion Lint Area to the Geometric Mean (GM) Break Modulus for bath tissues according to embodiments of the invention and for other bath tissue products.

In order to further understand the superiority of the Bath Tissues A to D according to the invention as compared to the Comparative Bath Tissues 1-9, a plot of the wet abrasion lint area to GM break modulus is shown in FIG. 3 for the tissues. As demonstrated by FIG. 3, the Bath Tissues A to D had a range of properties within the area marked A, while the Comparative Bath Tissues 1-9 had a range of properties within the area marked B. Note that the area A of Bath Tissues A to D encompasses a range of lower wet abrasion lint area while still having relatively low GM Modulus, whereas the area B of the Comparative Bath Tissues 1-9 encompasses a range of higher wet abrasion lint area and the same or much higher GM Modulus.

Figure 4:
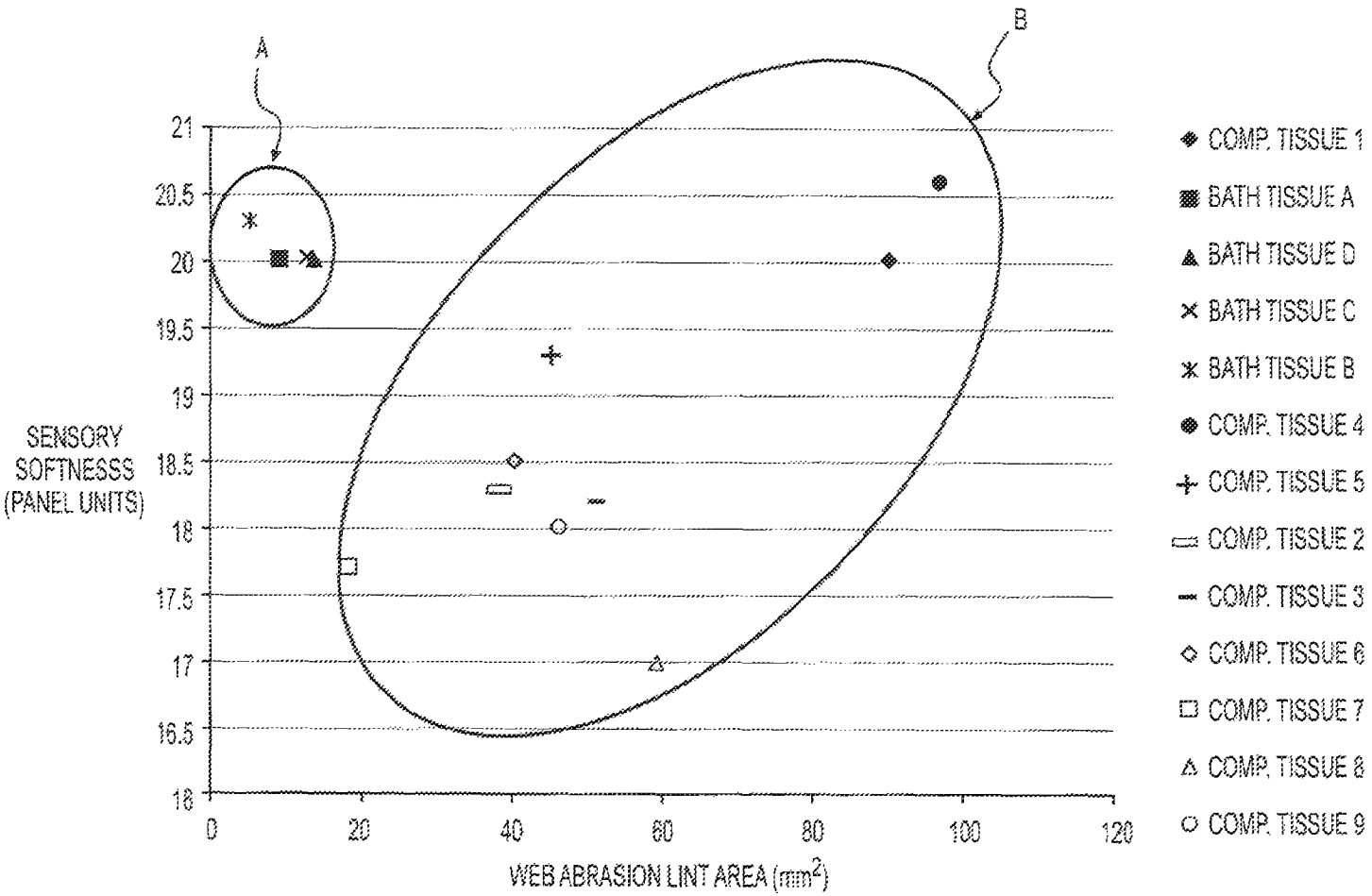
FIG. 4 is a plot showing the relation of Wet Abrasion Lint Area to Sensory Softness for bath tissues according to embodiments of the invention and for other bath tissue products.

FIG. 4 is a plot of the wet abrasion lint area to sensory softness for Bath Tissues A to D and Comparative Bath Tissues 1-9. As demonstrated by FIG. 4, that combination of wet abrasion lint area to sensory softness for Bath Tissues A to D is in a range, marked A, that is superior to the range, marked B, of properties of Comparative Bath Tissues 1-9. Thus, FIG. 4 further demonstrates that Bath Tissues A to D had a better combination of wet abrasion and softness than the Comparative Products 1-9.

Without being bound by theory, it is believed that the superior properties of the Bath Tissues according to the invention are due to the skillful combination of all the fibers, chemicals, and paper machine operating conditions for the production of the outer plies on the respective paper machines as listed in TABLES 1A, 2A, 3A, and 4A, and combining those outer plies with the respective center plies that have the correct GM modulus for making very soft bath tissue.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention can be used to produce desirable bath tissue products. Thus, the invention is applicable to the paper products industry.

We claim:

1. A multi-ply bath tissue comprising:

a first ply providing a first surface of the bath tissue, the first ply including first and second layers, the first layer of the first ply forming the first surface, the first layer of the first ply including a temporary wet strength resin and the second layer of the first ply being substantially free from a temporary wet strength resin; and a second ply providing a second surface of the bath tissue, the second ply including first and second layers, the first layer of the second ply forming the second surface, the first layer of the second ply including a temporary wet strength resin and the second layer of the second ply being substantially free from a temporary wet strength resin, wherein the bath tissue is free from regenerated cellulosic microfibers.

2. The multi-ply bath tissue according to claim 1, wherein the bath tissue includes at least about 15% northern softwood kraft fibers.

3. The multi-ply bath tissue according to claim 1, wherein the bath tissue includes eucalyptus fibers and at least about 25% northern softwood kraft fibers.

4. The multi-ply bath tissue according to claim 1, further comprising a third ply sandwiched between the first ply and the second ply.

5. The multi-ply bath tissue according to claim 4, wherein the third ply includes at least one of southern hardwood fibers, southern softwood fibers, and recycled fibers.

6. The multi-ply bath tissue according to claim 4, wherein the third ply includes only one layer and has temporary wet strength resin throughout the one layer.

7. The multi-ply bath tissue according to claim 4, wherein the third ply has a lower cross machine direction (CD) wet tensile strength than that of each of the first ply and the second ply.

8. The multi-ply bath tissue according to claim 1, wherein the bath tissue has a cross machine direction (CD) wet tensile strength of between about 50 grams to about 90 grams.

9. The multi-ply bath tissue according to claim 8, wherein the bath tissue has a cross machine direction (CD) wet tensile strength of between about 55 grams to about 85 grams.

10. The multi-ply bath tissue according to claim 8, wherein the bath tissue has a wet abrasion lint area to cross machine direction (CD) wet tensile strength ratio of less than about 0.3333 $mm^2$/gram when the wet abrasion lint area is determined according to the Wet Abrasion Lint Test.

11. The multi-ply bath tissue according to claim 10, further comprising a third ply sandwiched between the first ply and the second ply.

12. The multi-ply bath tissue according to claim 11, wherein the third ply has a lower CD wet tensile strength than that of each of the first ply and the second ply.

13. The multi-ply bath tissue according to claim 11, wherein the third ply includes at least one of southern hardwood fibers, southern softwood fibers, and recycled fibers.

14. The multi-ply bath tissue according to claim 13, wherein the third ply includes only one layer and has temporary wet strength resin throughout the one layer.

15. The multi-ply bath tissue according to claim 1, wherein the bath tissue has a wet abrasion lint area to cross machine direction (CD) wet tensile strength ratio of less than about 0.3333 $mm^2$/gram when the wet abrasion lint area is determined according to the Wet Abrasion Lint Test.

16. The multi-ply bath tissue according to claim 1, wherein the bath tissue has a cross machine direction (CD) wet tensile strength of between about 55 grams to about 75 grams.

17. The multi-ply bath tissue according to claim 16, wherein the bath tissue has a CD wet tensile strength of between about 65 grams to about 75 grams.

18. The multi-ply bath tissue according to claim 16, wherein the bath tissue has a wet abrasion lint area to CD wet tensile strength ratio of less than about 0.333 $mm^2$/gram when the wet abrasion lint area is determined according to the Wet Abrasion Lint Test.

19. The multi-ply bath tissue according to claim 18, wherein the wet abrasion lint area to CD wet tensile strength ratio is about 0.06 $mm^2$/gram to about 0.333 $mm^2$/gram.

20. The multi-ply bath tissue according to claim 16, wherein the bath tissue has a geometric mean (GM) break modulus of less than about 60 g/% strain.

21. The multi-ply bath tissue according to claim 16, wherein the bath tissue includes northern softwood kraft fibers and eucalyptus fibers.

22. The multi-ply bath tissue according to claim 21, wherein the bath tissue includes about 14% to about 40% northern softwood kraft fibers and about 60% to about 86% eucalyptus fibers.

23. The multi-ply bath tissue according to claim 16, wherein the bath tissue includes eucalyptus fibers and at least about 15% northern softwood kraft fibers.

24. The multi-ply bath tissue according to claim 23, wherein the bath tissue includes at least about 25% northern softwood kraft fibers.

25. The multi-ply bath tissue according to claim 16, further comprising a third ply sandwiched between the first ply and the second ply.

26. The multi-ply bath tissue according to claim 25, wherein the third ply includes at least one of southern hardwood fibers, southern softwood fibers, and recycled fibers.

27. The multi-ply bath tissue according to claim 26, wherein the third ply includes only one layer and has temporary wet strength resin throughout the one layer.

28. The multi-ply bath tissue according to claim 26, wherein the third ply has a lower CD wet tensile strength than that of each of the first ply and the second ply.

29. The multi-ply bath tissue according to claim 16, wherein the bath tissue has a caliper of greater than about 130 mils/8 plies.

30. The multi-ply bath tissue according to claim 16, wherein the bath tissue has a basis weight of between about 30 lbs/ream to about 40 lbs/ream.

31. The multi-ply bath tissue according to claim 16, wherein the bath tissue has a wet abrasion lint area to CD wet tensile strength ratio of about 0.15 $mm^2$/gram to about 0.25 $mm^2$/gram.

32. The multi-ply bath tissue according to claim 31, wherein the bath tissue has a wet abrasion lint area to CD wet tensile strength ratio of about 0.20 $mm^2$/gram.

* * * * *